United States Patent [19]

Allred

[11] Patent Number: 4,944,664

[45] Date of Patent: Jul. 31, 1990

[54] CONCRETE WALL FORM APPARATUS

[76] Inventor: Cecil F. Allred, 1307 Oak, Othello, Wash. 99344

[21] Appl. No.: 409,389

[22] Filed: Sep. 19, 1989

[51] Int. Cl.[5] ..... E04G 11/34; E04G 17/00

[52] U.S. Cl. ..... 425/63; 74/397; 192/85 CA; 249/20; 249/33; 249/210

[58] Field of Search ..... 425/62, 63; 249/1, 13, 249/18, 33, 34, 210, 219.1, 19, 20; 74/397, 665 GA; 192/66, 70, 15, 85 C, 85 CA

[56] References Cited

U.S. PATENT DOCUMENTS

| | | | |
|---|---|---|---|
| 1,414,287 | 4/1922 | Knudson | 249/37 |
| 1,435,488 | 11/1922 | McGregor | 425/65 |
| 1,562,465 | 11/1925 | Nelson | 249/47 |
| 2,025,703 | 12/1935 | Baily et al. | 404/117 |
| 2,055,970 | 9/1936 | Fippard | 192/85 CA |
| 2,187,223 | 1/1940 | Cory | 264/33 |
| 2,331,657 | 10/1943 | Crom | 264/32 |
| 2,333,041 | 10/1943 | Poulter | 404/75 |
| 2,388,857 | 11/1945 | Lindsley | 192/85 CA |
| 2,501,136 | 3/1950 | Miller | 425/363 |
| 2,590,185 | 3/1952 | Land | 354/303 |
| 2,710,417 | 6/1955 | Short | 74/397 |
| 3,288,534 | 11/1966 | Gonski | 74/397 |
| 3,306,835 | 2/1967 | Magnus | 204/157.62 |
| 3,431,797 | 3/1969 | Galbarini et al. | 74/665 GA |
| 3,497,579 | 2/1970 | Barron | 264/33 |
| 3,548,467 | 12/1970 | Allred | 425/63 |
| 3,621,694 | 11/1971 | Greenberger | 72/226 |
| 4,050,255 | 9/1977 | Ahlgren | 405/288 |
| 4,060,446 | 11/1977 | Carter | 74/397 |
| 4,313,536 | 2/1982 | Fauth | 74/665 GA |
| 4,605,084 | 8/1986 | Haynes et al. | 74/665 GA |
| 4,736,653 | 4/1988 | Hayakawa et al. | 74/665 GA |
| 4,800,780 | 1/1989 | Sivalingham | 192/85 CA |
| 4,807,458 | 2/1989 | Buch et al. | 74/665 GA |

*Primary Examiner*—James C. Housel

*Attorney, Agent, or Firm*—Wells, St. John & Roberts

[57] ABSTRACT

A concrete wall forming apparatus is described that facilitates formation of an elongated concrete wall between opposed sheet forms. An assemblable frame mounts the sheet forms in upright opposed orientations. The frame supports pairs of driven rollers that move against external surfaces of the sheet forms along the length of the wall as concrete is being poured. Each pair of rollers is driven by a selectively removable drive assembly including a single motor drive and gear arrangement by which both rollers of the pair are driven simultaneously. At least one of the rollers is connected to the driving gears through a clutch arrangement. The clutch may be selectively operated to disengage the roller at the inside of a corner, thereby allowing that roller to remain stationary while the remaining roller rotates to move about the outward radius of the corner. The clutch can then be engaged so that continued operation of the motor will result in corresponding counter-rotation of both rollers and movement of the roller pair along the path beyond the corner.

26 Claims, 10 Drawing Sheets

II-II
29
30
98
15
55
42
40
19
12
33
34
69
70
14
10
54
43
32
44
24
11
28
27
18

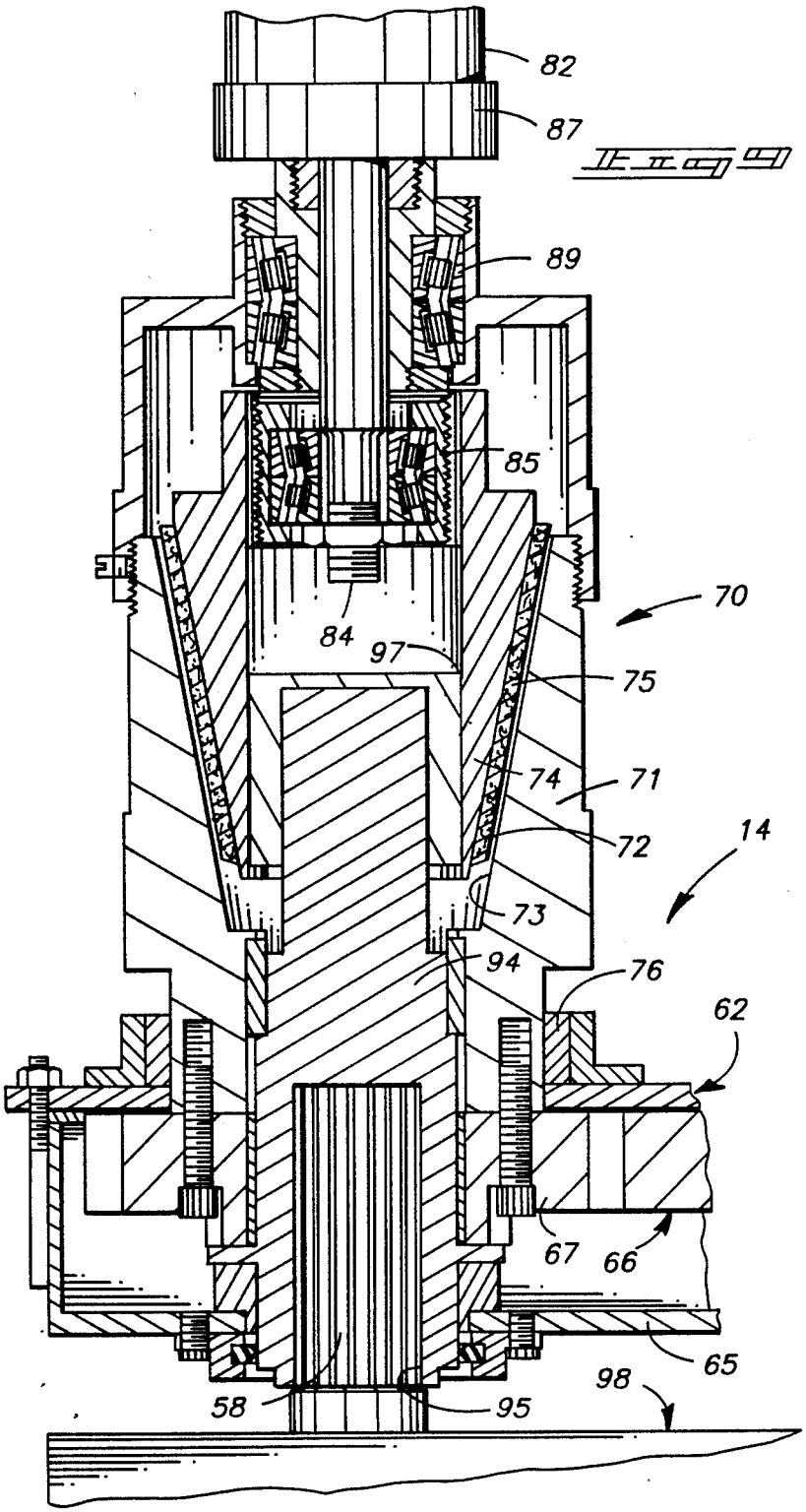
82
87
89
85
70
84
97
75
74
71
72
14
73
94
76
62
67
66
65
98
58
95

CONCRETE WALL FORM APPARATUS

TECHNICAL FIELD

The present invention relates to concrete forming apparatus and more particularly to such apparatus utilizing paired driven rollers to support sheet forms as concrete is poured to progressively form an elongated concrete wall including a corner.

BACKGROUND OF THE INVENTION

Frequently the cost of concrete forms and the time required to assemble the forms greatly exceeds the cost of the concrete itself and the pouring of the wall configuration. The forms are quite bulky, are difficult to handle, and require a large number of man hours to assemble and dissemble.

As a solution to this problem, I developed a concrete form apparatus as disclosed in U.S. Pat. No. 3,548,467. The apparatus disclosed functioned to support portable forms as an elongated concrete wall is being poured. Concrete was poured between two forms using movable supporting tracks and a series of carriages that moved vertically oriented backup rollers along outwardly facing surfaces of the forms. The rollers prevented the forms from buckling or bulging as concrete was progressively poured. This apparatus included an independent motor for each of the upright rollers on each carriage. Operation of the motors would cause rotation of the rollers and corresponding movement of the roller pair along the forms.

Difficulty was experienced, however, with the independently operating motors. In practice, hydraulic motors were utilized. It was found that slight pressure variations in the hydraulic lines would cause the motors to operate at slightly varying speeds. This would have the effect of slowing or speeding one of the rollers in relation to the other.

The rollers, being tied together by carriages at the upward ends thereof, could therefore become undesirably angularly oriented relative to the wall. The rollers would thus being against the sheet forms.

Another problem encountered with the dual motor arrangement was observed at corners.

The drive motor and roller at the inside of the wall was required to slow or come to a complete stop while the roller and motor at the outside of the wall were operated to move around the outside corner. Difficulty was experienced in properly controlling this function utilizing the two individual motors.

The present invention was conceived to overcome the above problems while maintaining the desirable features of the concrete wall forming apparatus shown in my issued U.S. Pat. No. 3,548,467.

BRIEF DESCRIPTION OF THE DRAWINGS

A preferred embodiment of the present invention is illustrated in the accompanying drawings in which:

FIG. 9 is an enlarged sectional view of a clutch mechanism with the clutch disengaged;

FIG. 10 is a view similar to FIG. 9 only showing the clutch engaged.

DETAILED DESCRIPTION OF THE PREFERRED EMBODIMENT

The following disclosure of the invention is submitted in compliance with the constitutional purpose of the Patent Laws "to promote the progress of science and useful arts"(Article 1, Section 8).

Figure 1:
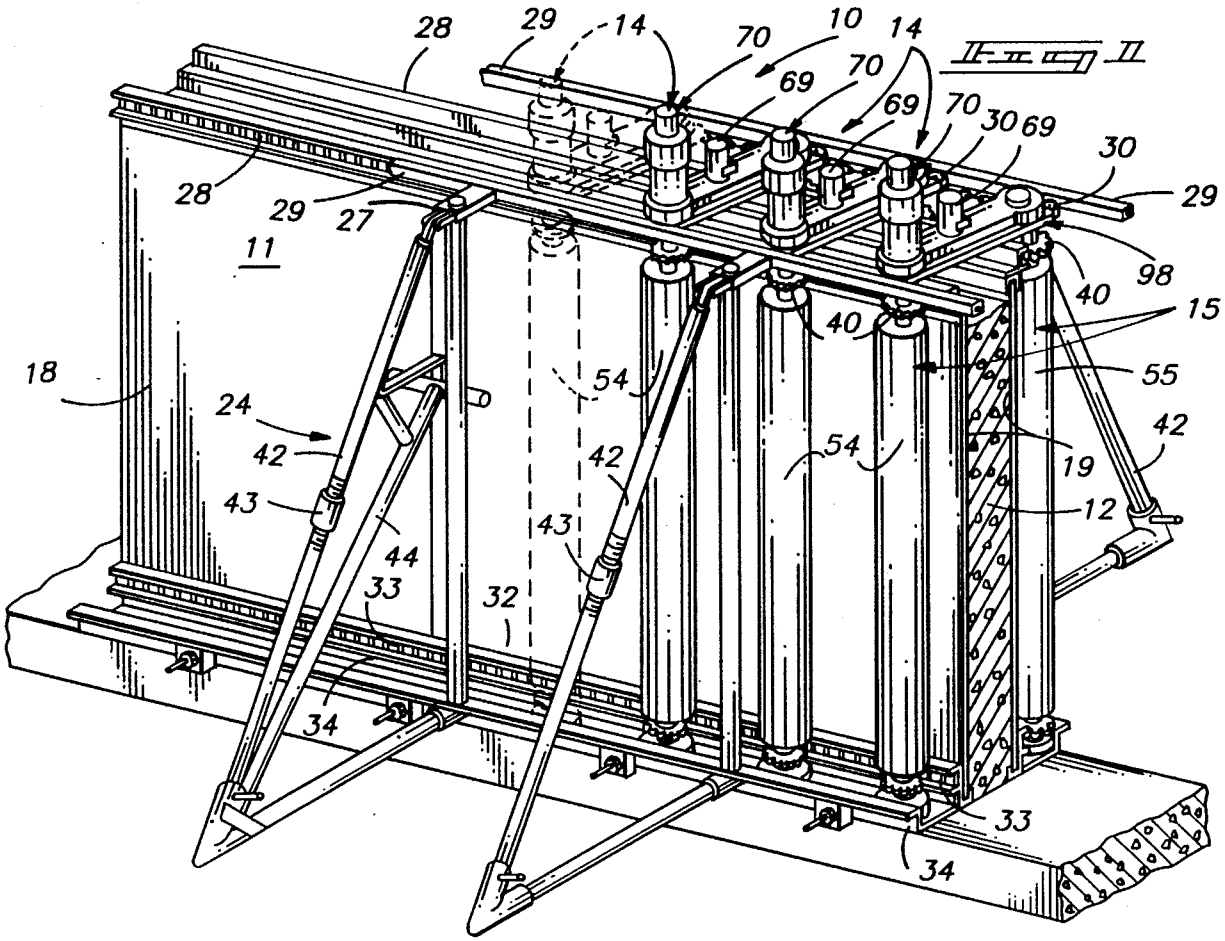
FIG. 1 is a perspective view showing a portion os a wall being formed and of features of the present form apparatus.

A preferred embodiment of the present improved apparatus is generally designated in the drawings by the reference character 10. The appataus 10 makes use of individual discrete sheet forms 11 for the purpose of progressively forming an elongated concrete wall 12 (FIG. 1). The concrete wall 12 may include one or more corners 13 (FIGS. 4, 11) along the length thereof.

In general, the present invention includes a unique drive 14 for moving a succession of roller pairs 15 along the sheet forms 11. The moving roller pairs prevent the sheet forms from bulging or buckling as concrete is being poured between the sheet forms to produce the elongated wall 12.

The sheet forms 11 may be constructed of standard plywood sheets. It is preferred that standard sheet configurations be utilized in an overlapping relationship as described in my U.S. Pat. No. 3,548,467 which is hereby incoporated by reference herein.

Figure 4:
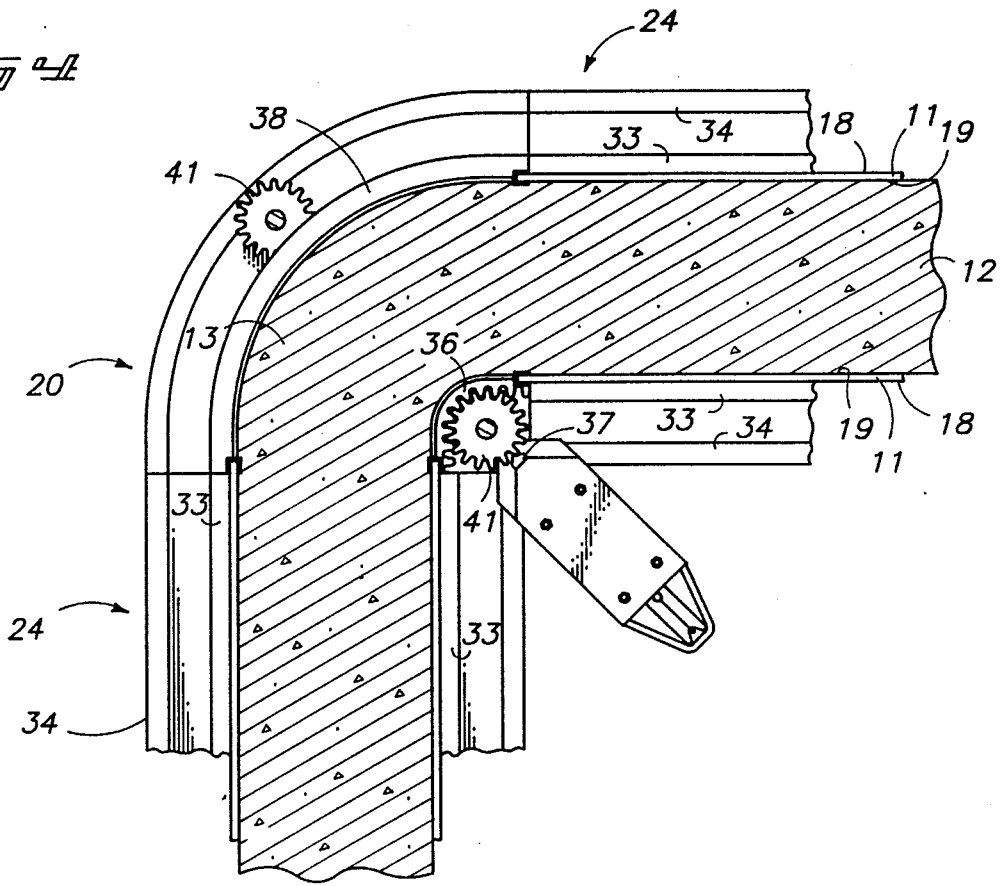
FIG. 4 is a fragmented plan sectional view showing guide elements of the invention at a wall corner.
Figure 11:
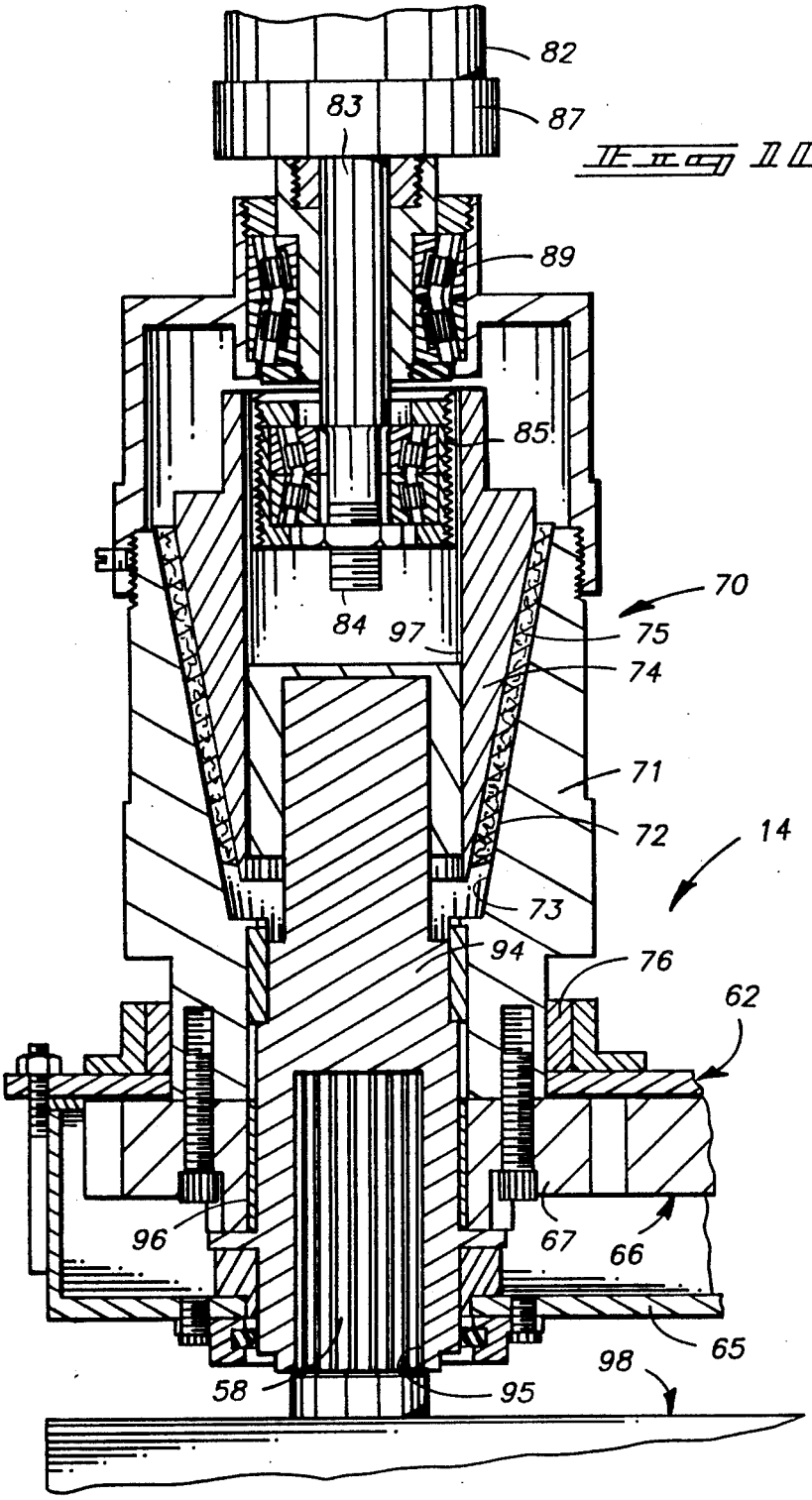
FIG. 11 is an enlarged fragmentary top plan view showing the present apparatus at a corner of a wall being formed.
Figure 11:
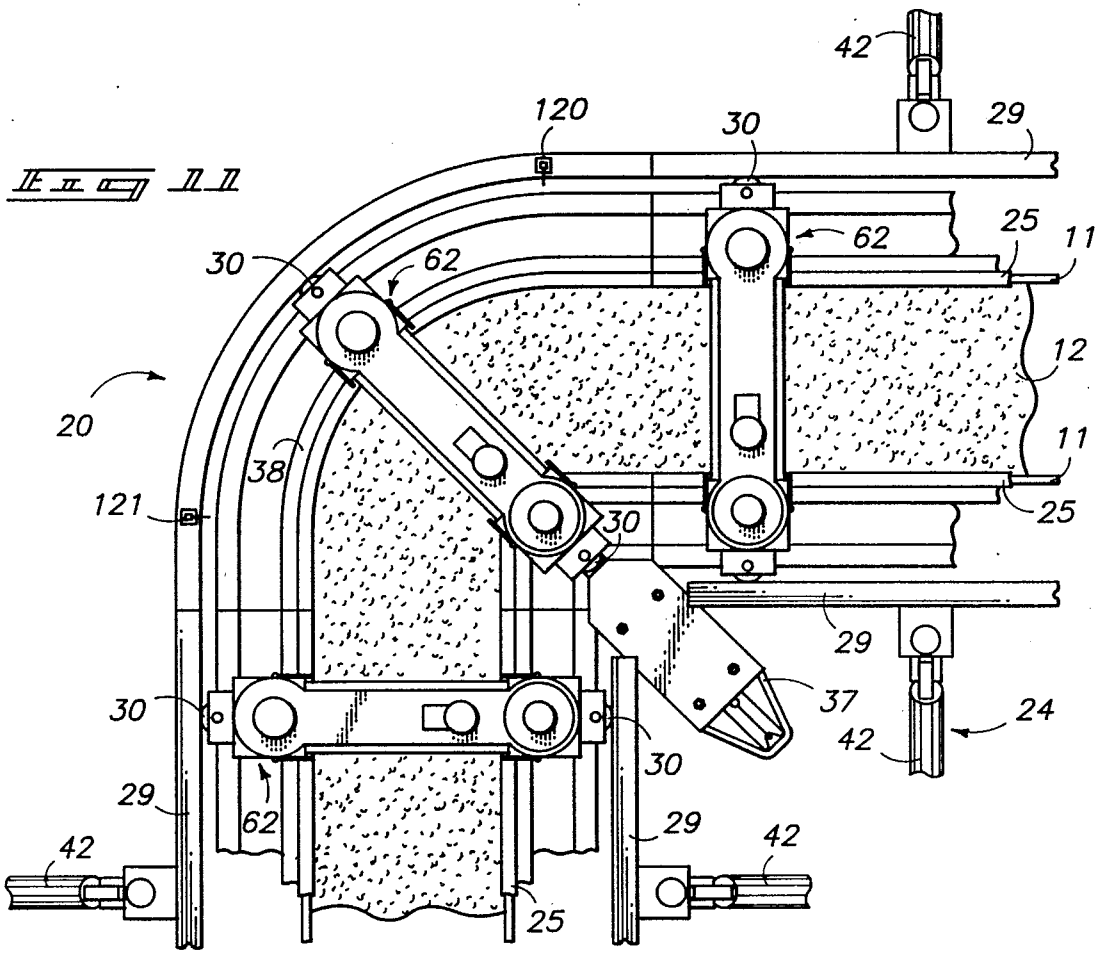

The assembled sheet forms 11 include opposed outwardly facing surfaces 18. Inwardly facing surfaces 19 define the thickness dimension of the completed concrete wall 12. The sheet forms 11 may lead along the wall to one or more corner forms 20 (FIGS. 4, 11).

The corner forms 20 are formed of rigid material on prescribed radii according to the desired wall thickness dimension. A corner 13 is thus formed in an equal thickness dimension to the wall but includes a curved configuration as opposed to common "right angle" corner typically found in foundation and other concrete wall structures. The corners 20 are rounded to facilitate continuous motion of the drive 14 and roller pairs 15 around the corners during formation of the concrete wall.

A form support frame is generally indicated at 24 in FIG. 1 of the drawings. The form support frame 24 is utilized to receive and mount the sheet forms 11 and corner frames 20 to define the space into which concrete is poured to form the elongated wall 12. The support frame 24 therefore supports the forms 11 and 20 in spaced apart upright relation with a desired spacing between their inwardly facing surfaces 19 in order to determine the finished wall thickness dimension.

The support frame 24 includes an upward or top frame end 27 including an elongated pair of guide tracks 28 (FIGS. 1, 5) on opposite sides of the sheet forms 11.

Pairs of elongated rails 29 also extend along the length of the wall on each side of the wall, supported by the frame 24. Edge rails 25 extend along the top edges of the sheet forms 11. The rails 29 and the top rails 25 respectively are engaged by sets of guide wheels 30, 31 that are operably connected to the roller pairs 15 in order to movably support and maintain the roller pairs in an upright orientation.

The support frames also include bottom ends 32 (FIGS. 1, 2, 3) which include guide tracks 33 and bottom rails 34 on opposite sides of the sheet forms. The rails 34 provide surfaces for engagement by guide wheels 35 of the individual roller pair assemblies.

The tracks 33, along with the upper guide tracks 28, aid in imparting motion of the rollers along the forms by meshing engagement with sprocket pairs 40, 41 on top and bottom ends of the roller pairs 15.

The top sprockets 40 mesh with the elongated guide tracks 28 at the top end of the frame. The similar sprockets 41 at the bottom roller ends engage and mesh with the bottom guide tracks 33. The sprockets and tracks are descibed in detail in my above referenced patent.

As a corner 13 is encountered, the sprockets 40, 41 will ride over appropriately toothed inner and outer corner track segments 36, 38 (FIG. 4) that are joined to the tracks 28, 33. The corner segments 36, 38 are provided to be coextensive with the adjacent straight track sections so the sprockets will move easily from the straight track sections and about the corner forms 20.

Adjacent each inner corner segment 36 is a corner retainer member 37. The retainer is a spring biased keeper with a pointed end for releasably engaging and urging the adjacent sprocket against the inside corner segment 36. The retainer also inhibits undesired motion of the connected roller at the inside of the corner while the remaining, outward roller continues to rotate and move about the outer corner segment 38 on a radius from the inner roller.

The frame further includes angled braces 42 that project to opposite sides of the sheet forms 11. The angle braces are utilized to hold the frame components discussed above in a prescribed upright and spaced orientation.

Turnbuckles 43 (FIG. 1) are provided on the angled braces 42 to facilitate angular adjustments of the forms, the upper rails 29, and guide tracks 28 into precise upright orientation. The turnbuckles 43 may be tightened or loosened in order to selectively adjust the top rails and guide tracks toward or away from the opposed rails and guide tracks on the opposite side of the wall.

The form support frame may also include pivoted side braces 44. The side braces are pivotable on the frame to selectively engage the outer surfaces of the sheet forms and provide supplementary bracing following passage of the present roller pairs 15.

Figure 2:
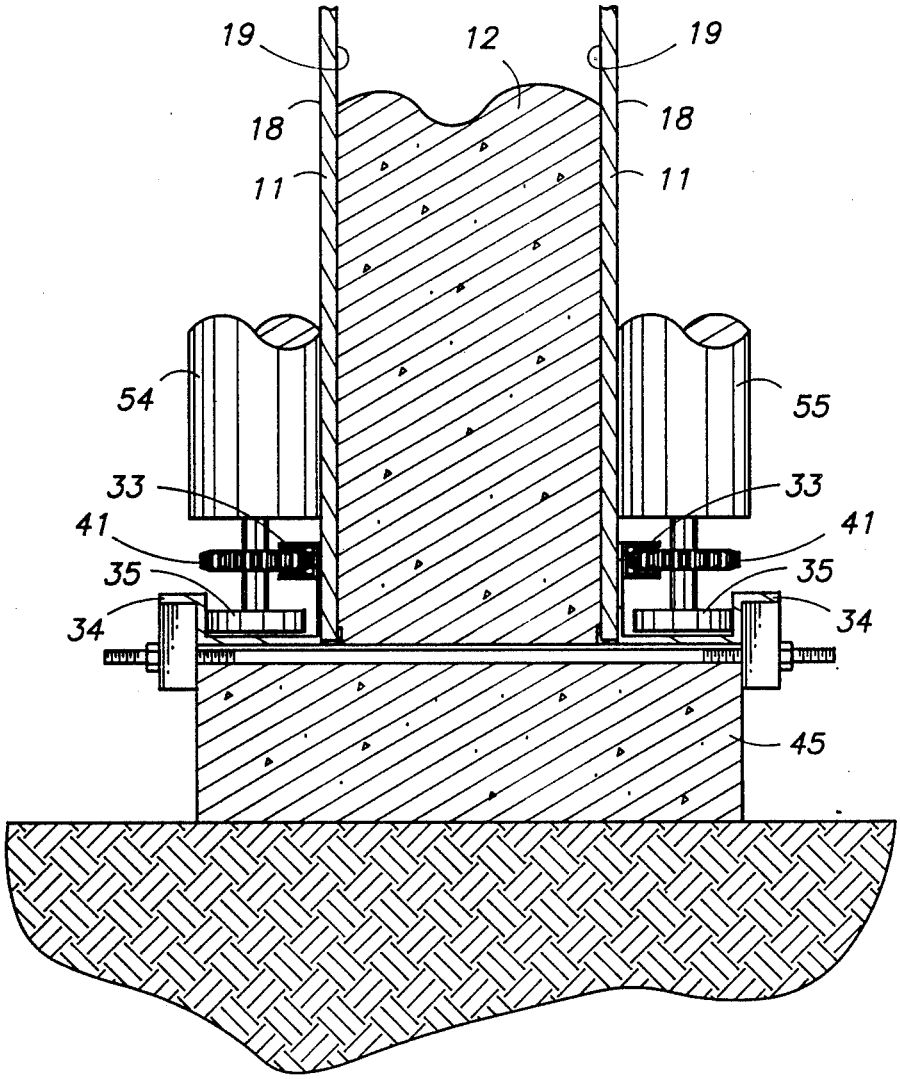
FIG. 2 is an enlarged sectional view of a footing and lower portions of the present apparatus.

The apparatus may be assembled atop a previously formed footing 45 as shown in FIG. 2 and as discussed in the above incorporated patent. The footing 45 will support the bottom rails and tracks and, will correspondingly support the assembled sheet forms 11.

In the present improvements, if additional finished wall height is required, a footing spacer means 46 is alternatively provided for releasably mounting the sheet forms at selected heights. Means 46 thereby enables formation of concrete walls at selected height dimension.

Figure 3:
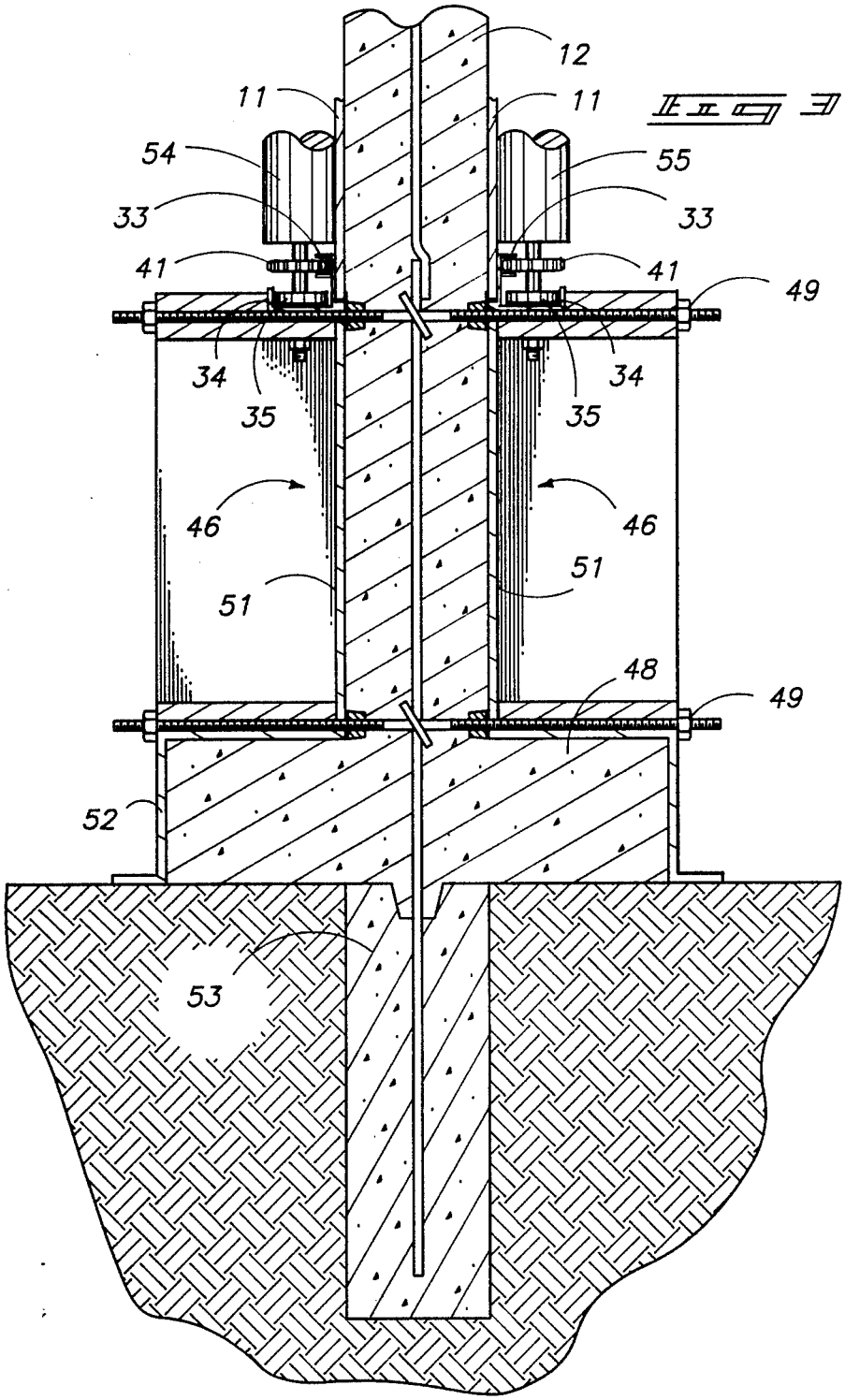
FIG. 3 is a view similar to FIG. 2 only showing an alternative footing spacer arrangement.

The footing spacer means 46 is best illustrated in FIG. 3. There, a integrated concrete footing section 48 is shown, formed with the wall as the concrete is poured.

The footing spacer means advantageously includes wood stud braced upright sections 51 that are substantially coplanar with the sheet forms 11. The height dimension of the sections 51 is selected to proved height in addition to the height of the sheet forms. For example, a ten foot high wall may be constructed utilizing standard eight foot length plywood for the sheet forms with upright spacer sections 51 of approximately two feet in height. Thus, the total overall height of the wall will include the sum of the sheet form height (eigth feet) and the height of the upright sections 51 (two feet).

The footing spacer means also includes a footing forming section 52 of each side of the wall configuration for forming the footing section 48 integrally with the wall. To provide additional stability, it is desirable to secure upright reinforcing steel extending upwardly from a previously poured downwardly extending footing leg extension 53, through the footing, the lower portions of the wall, to ends which may be used to attach longer reinforcing steel rods for the remainder of the wall.

It is preferred that the upright sections 51 of the footing spacer means be releasably held together by form ties such as the sheet bolts 49 shown in FIG. 3.

Figure 5:
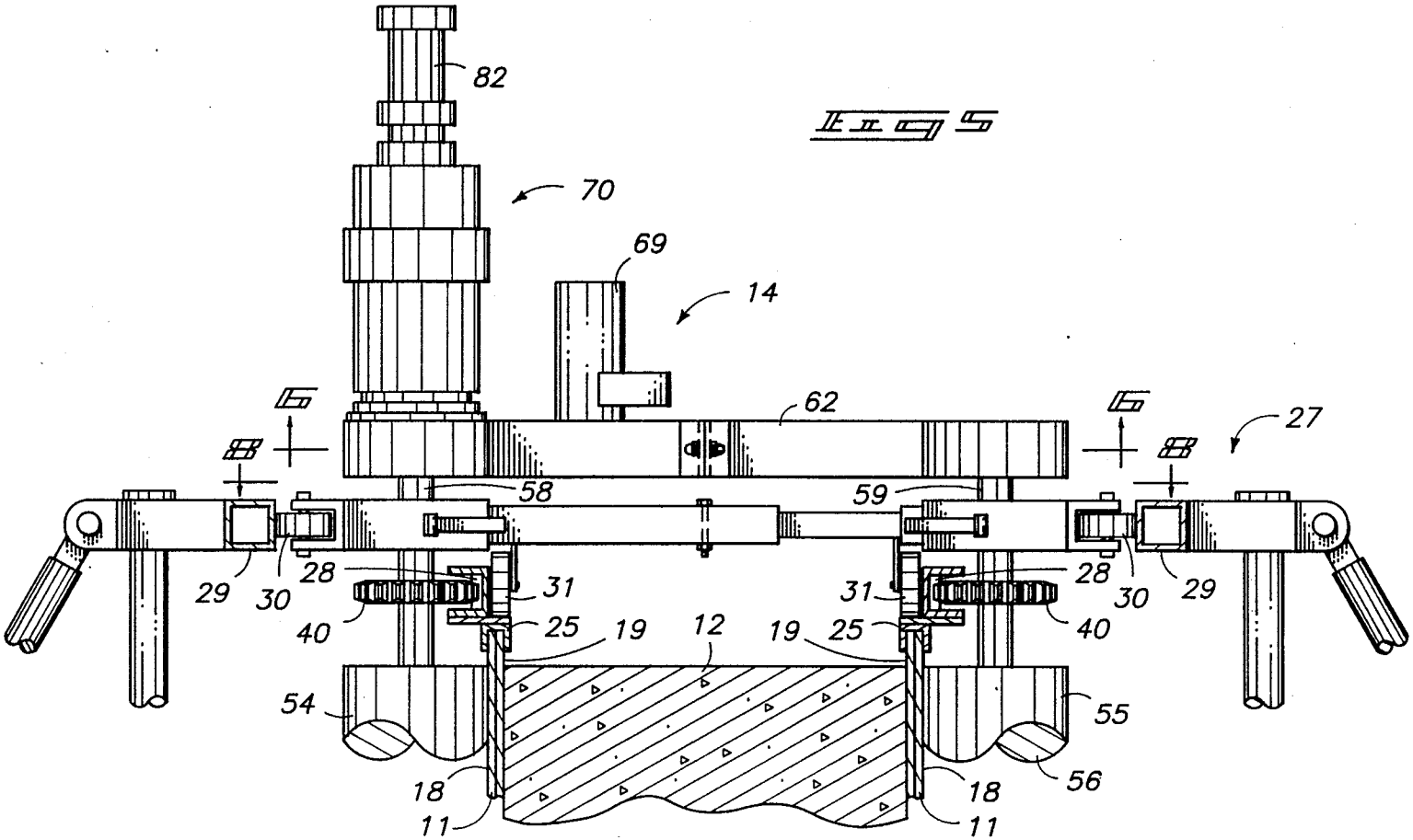
FIG. 5 is an enlarged fragmented detail view of the apparatus components adjacent the top of a wall being formed.

Reference will be now made in greater detail to the individual roller pairs 15 (FIGS. 1, 2, and 5). Each of the roller pairs 15 includes an upright first roller 54 with a cylindrical roller surface engaging the outwardly facing surface 18 of the adjacent sheet forms 11. Each pair also includes a second upright roller 55 parallel to the first roller 54 and spaced across the wall width therefrom. The second roller is substantially identical to the first roller, being oriented in an upright orientation and having a substantially cylindrical surface to roll against the outwardly facing surface 19 of the opposite sheet form 11.

The rollers 54, 55 are preferably rigid along their length dimensions. As shown in FIG. 1, several successive pairs of the rollers are provided. A selected number of roller pairs 15 are spaced along the wall, depending upon desired pouring conditions and speed at which the wall is to be formed.

Powered rotation of the rollers is transmitted to the sprockets which, meshing with the guide tracks, cause the rollers to move in the prescribed direction along the path defined by the forms.

The upward splined ends 58, 59 of the form engaging rollers 54, 55 of each pair are connected by a mechanism generally designated as a carriage frame 62 (FIG. 5). The carriage frames 62 shown for the several roller pairs 15 in FIG. 1 are substantially identical. The figures showing detail of an individual carriage frame 62 are thus typical of any one of the frames shown.

Figure 6:
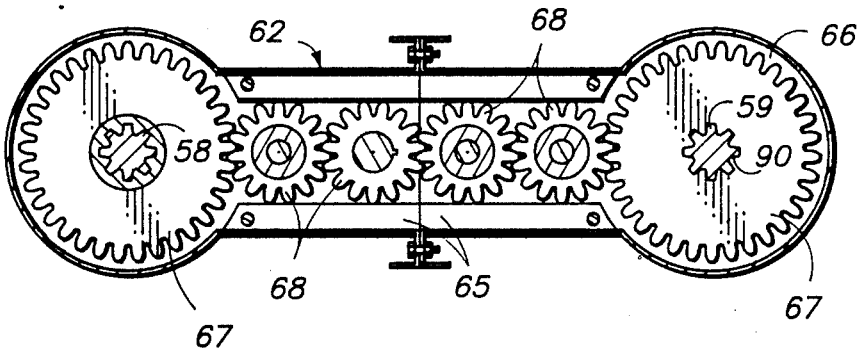
FIG. 6 is a sectional view taken on line 6—6 in FIG. 5.
Figure 7:
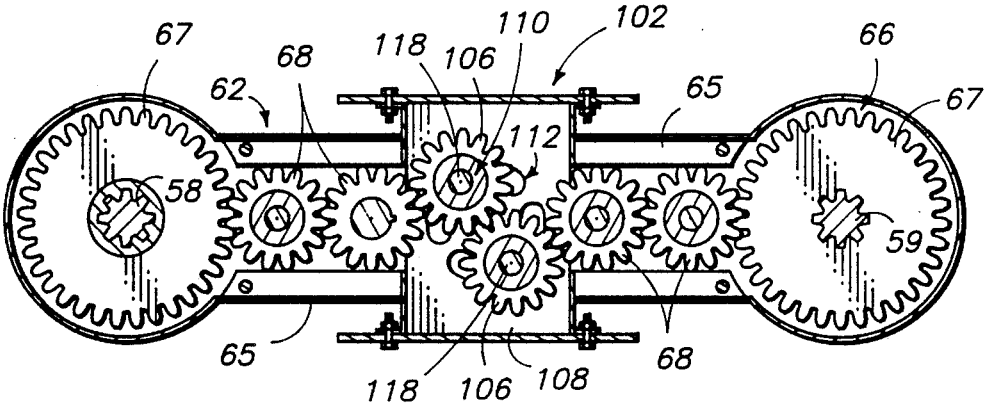
FIG. 7 is a sectional view similar to FIG. 6 only showing addition of an idler insert.

Each carriage frame 62 includes selectively joined split housing sections 65. The housing sections 65 rotatably mount a drive gear assembly 66 (FIGS. 6, 7) for transmitting rotary motion to the rollers 54, 55.

Of the gears in assembly 66, two are primary drive gear wheels 67. In the preferred embodiment one of the drive gear wheels 67 is connected substantially directly to one of the rollers 54, 55; while the other is connected through a clutch 70 (described in detail below) to the remaining roller. Gear wheels 67 preferably include equal pitch diameters.

The gear drive assembly 66 also includes an even number of intermeshing pinion gears 68. The pinion gears 68 are also advantageously of equal pitch diameters. The common pitch diameter of the pinions is selected along with the pitch diameter of the drive gear wheels 67 to space the axes of the primary drive gear wheels 67 apart to achieve a desired wall thickness.

The carriage frame 62 and the drive mechanism thereon is adjustable by means of an idler insert 102. The idler insert 102 is mountable between the drive gears 66 to selectively space the drive gears apart and thereby adjust the distance between the rollers to accommodate differing wall thickness dimensions.

The idler insert 102 may be comprised of a pair of idler gears 106. The paired idler gears 106 assure that rotary motion of one roller will be opposite or counter to that of the remaining roller.

The pair of idler gears 106 are rotatably mounted to an idler gear frame 108 that is selectively mountable between the split housing sections 65. The gear frame 108 may include means 110 for mounting the pair of idler gears to the gear frame in meshing engagement. Such means 110 preferably includes an adjustment means 112 between at least one of the idler gears 106 and gear frame 108.

At least one of the idler gears 106 may be selectively moved along a slot 107 in the gear frame 108 while remaining in meshing engagement with the opposite idler gear 106. Selective positioning may be achieved by releasably securing the gear axle shaft 118 in the slot by a conventional bolt or nut (not shown) thereon. The newly adjusted relationship between the two gears will effect spacing of the drive gears and engaged rollers further apart or closer together, depending upon the adjusted position of the idler gears within the slots.

Alternatively, the pairs of idler gears 106 could be provided in fixed positions on the idler frame. Sets of such idler gears (not shown) could be provided for insertion between the split housing sections 65 to adjust spacing to standard, selected wall thickness dimensions.

In the preferred drive 14, one of the pinions 68 is connected to a single drive motor 69. Each drive motor 69 is preferably hydraulically operated, driven by a standard, conventional pump and valving arrangement (not shown). Rotary motion from the motor may be transmitted through the intermeshing gears 67, 68 (and idler gears 106, if used) to cause counter rotation of both rollers 54, 55 simultaneously and at the same velocity due to the described mechanical connection through the drive gear assembly 66.

Another important aspect of the present invention is provision of the clutch 70 (FIGS. 1, 9, and 10). The clutch 70 is interposed between at least one of the rollers 54, 55, and the drive gear assembly 66. It is operable as the apparatus encounters a corner 13 to permit motion of the roller pair about the corner. Such operation will be described in greater detail following further description of the clutch structure below.

It is conceivable that an additional identical clutch (not shown) be provided and connected with the remaining drive gear. Such provision would facilitate additional operational capability. However, in the preferred arrangement, a single clutch 70 is disclosed.

The clutch 70 includes a clutch housing 71 mounted to one of the primary drive gear wheels 67. The clutch housing 71, being connected to a primary drive gear wheel, will rotate with the gear in relation to the carriage frame 62. The housing 71 extends upwardly through a bearing 76 on the frame 62, coaxial with the adjacent roller below.

The clutch housing 71 includes a first clutch member 72. Member 72 is mounted to or is integral with the clutch housing 71. It includes a conical friction surface 73.

A second clutch member 74 is operably mounted to the adjacent roller and is coaxial with the roller and the clutch housing 71. The second clutch member 74 includes a conical friction surface 75 for selective engagement with the friction surface 73.

An actuator means is generally shown at 77 mounting one of the clutch members. Transmission of rotary drive between the associated drive gear wheel and the adjacent roller is controlled by selective operation of the actuator means 77 to engage and disengage the clutch members 72, 74.

In a preferred example, the actuator means 77 includes an actuator cylinder 82. The cylinder is preferably a conventional double acting hydraulic cylinder, and includes a piston 83 having an outward threaded end 84. The threaded end 84 receives a bearing 85, clamping its inner race. The bearing 85 includes an outer race that is mounted for rotation with the second clutch member 74. The bearing 85 will transmit axial motion of the piston 83 to the second clutch member 74. The bearing 85 will also permit relatively free rotational motion of the second clutch member 74 in response to engagement with the first clutch member 72.

The actuator cylinder 82 further includes a cylinder body 87. The body 87 is mounted through a bearing 89 to the clutch housing 71. Bearing 89 permits independent rotation of the clutch housing while providing axial support to the cylinder 82. Thus, the cylinder 82 may remain relatively stationary while the clutch housing 71 and second clutch member 74 may rotate together or independently depending upon engagement or disengagement of the two conical friction surfaces 73, 75.

The second clutch member 74 includes an axially slidable socket member 94. Member 94 includes a splined surface 95 that opens downwardly to receive a male spline end 58 of the adjacent roller 54.

The socket member 94 is rotatably journaled by a bushing 96 within the adjacent drive gear wheel 67. Socket member 94 therefore has the ability to rotate independently of the adjacent drive gear wheel 67.

An upward end of the socket member 94 is axially keyed to be received within a similarly keyed bore 97 of the second clutch member 74.

The above key way arrangement permits axial motion of the second clutch member 74 but will transmit any rotary motion of the clutch member through the socket member 94 to the engaged roller 54.

With the above arrangement, selective operation of the actuator means will determine whether the engaged roller 54 will be powered to rotate by the drive motor 69, or whether the same roller 54 will "freewheel" while the drive motor and gears continue to operate, transmitting rotary motion to the remaining roller 55.

When the clutch piston 83 os extended, the friction surfaces are engaged and rotary motion of the drive gears 66 is transmitted to the roller 54. When the piston 83 is retracted, the friction surfaces are disengaged so the drive gears may continue to rotate while the roller 54 freewheels.

A splined recess 90 (FIGS. 6, 7) is provided in the drive gear wheel 67 opposite the clutch 70 to receive a similarly splined end 59 of the opposite roller 55. The splined bore 95 of socket member 94 and the splined recess 90 enable selective mounting and dismounting of the entire drive 14 from the paired rollers 15. The carriage frame 62, along with the drive gearing, motor, and clutch may therefore be lifted upwardly to disengage the splined roller ends 58, 59. This is done to facilitate assembly and dissembly of the unit with the drive remaining relatively intact at all times.

Furthermore, removability of the drive 14 may facilitate selective positioning of the clutch and actuator mechanism form one roller of a pair to the other. When an "inside" corner is encountered, the drive is situated so the clutch and actuator will control rotation of the roller 54 destined to move about the inside of the corner. The remaining, outward roller 55 will continue rotation at the outer surface of the corner. Then, when a opposite "outside" corner is encountered, the carriage frame can be lifted, rotated 180 degrees, and lowered again onto the splined ends 58, 59 of the rollers. The clutch and actuator are then positioned in operating engagegment with the opposite roller which, at that time becomes the inner roller for the corner.

Figure 8:
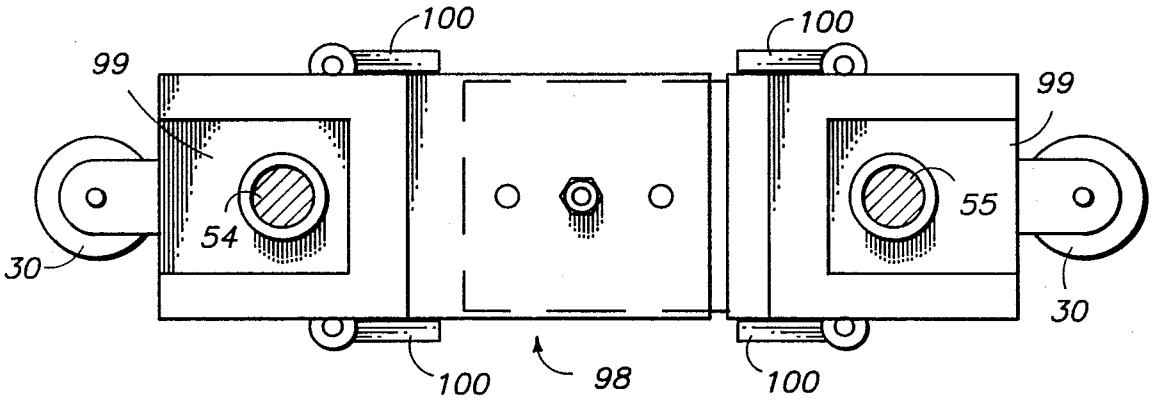
FIG. 8 is a sectional view taken on line 8—8 in FIG. 5.

To further facilitate assembly and dissembly of the roller pairs, a secondary carriage frame 98 (FIGS. 1, 5, and 8) is provided between the drive carriage frame 62 and the rollers of each pair. The secondary carriage frame 98 is split (FIG. 8) into two sections and is substantially similar to the split carriage shown and described in my above-referenced patent.

The secondary carriage frame 98 mounts the guide wheel sets 30, 31 for engaging the rails 29 and top sheet form rails 25 along the top of the form support frame. The secondary carriage frame 98 also includes removable bearings 99 rotatably journaling the rollers 54, 55. Release pawls 100 are provided on the secondary carriage frame 98 and are operable to releasably secure the bearings 99 and the rollers to the secondary frame 98. Alternatively, the pawls 100 may be operated to release the rollers for dissembly from the forms and form support frame.

As noted above, the carriage frame 62 includes a split housing arrangement 65. Similarly, the secondary carriage frame 98 is split to facilitate adjustment to accomodate varying wall thickness. To facilitate such adjustment, the secondary carriage frame is simply comprised of relatively telescoping sections as described in my referenced patent.

It is pointed out that the clutch actuator cylinder 82 may be hydraulically operated as may be the drive motors 69. The clutch cylinders 82 and drive motors 69 for the several driven pairs of rollers may be operated from a standard source of hydraulic fluid under pressure (not shown) using standard, conventional driving mechanisms and valving. To facilitate relatively automatic control at corners, however, a particular control arrangement (FIG. 11) may be provided by which the clutch mechanisms will be automatically actuated to operate. This is done as the corner is encountered and negotiated by the individual drives and roller pairs. Thus, a switch 120 may be provided along the frame adjacent a corner form 20 to be engaged by the approaching roller pair and drive mechanism.

Switch 120 may be operated as the roller pair come into position and the inward roller 54 of the pair comes into contact with the inward corner segment 36. At this point, the switch 120 would be actuated and, in response, the clutch cylinder 82 would be operated to disengage driving force to the adjacent roller. The roller is therefore permitted to remain stationary while the opposite roller 55 is continuously driven to move about the outward surface of the corner. The roller pair will therefore pivot about the corner as shown in FIG. 11 until the pair again becomes transversely oriented across the sheet forms extending beyond the corner.

A second switch 121 may be positioned along the frame to sense proper alignment of the rollers across the sheet forms and to operate the clutch mechanism to engage and cause transmission of driving power to the associated roller 54. The inward roller 54 again begins to roll and the roller pair 15 will again move in unison along the predetermined path defined by the sheet forms and forms support frame.

Operation of the present apparatus is preceded by construction of the forms support frame and mounting of the sheet forms 11 to determine the configuration of the concrete wall to be formed along a predetermined path. The construction of the sheet forms along with the forms support frame may follow the same basic procedure outlined in my above-referenced United States patent. However, additional capabilities may be provided in the turnbuckle arrangement 43 for secuing the sheet forms in proper "plumb" relationships.

Additionally, the footing spacer means 46 may be utilized where it is desired to integrate the poured wall and the footing, or where it is desirable to extend the wall height by the additional height dimension of the upright sections 51. Assembly will otherwise closely resemble assembly of the support frame on a previously formed and cured footing as shown in FIG. 2 and as descibed in my earlier patent. The exception, of course, is use of conventional ties for holding the upright sections together during the pouring process. The standard ties can simply be attached by conventional, known construction techniques for later removal from the forms after the poured wall has sufficiently cured to a self supporting state.

Once the forms support frame and sheet forms 11 are assembled and secured, the roller pairs 15 and drives 14 may be assembled. This is done firstly by positioning the rollers 54, 55 of each pair in upright orientations with their opposed top and bottom sprockets 40, 41 engaging the top and bottom guide tracks 28, 33 along the frame. Successive pairs of rollers are positioned in spaced relation along the assembled forms this manner.

As the rollers of each pair are mounted to the tracks, the bearings 99 at the upward roller ends are slid into engagement with the pawls 100 of the seconary carriage frame 98. The release palls 100 will engage and secure the bearings with the roller ends separate as desired across the wall thickness dimension.

Next, a drive 14 may be connected to the upward splined ends of each roller pair. This is done on each roller pair simply by lowering an entire drive 14 over each roller pair. The upward splined ends of the rollers will be received within the complimentary splined sockets of the drive.

Care is taken at this point to situate the drive with the clutch arrangement oriented over the roller which will, at some point or points along the predetermined path, encounter an "inside" segment of a corner. The clutch mechanism will therefore be positioned to enable continued operation of the roller pair about the corner as will be further discussed below.

The assembly described to this point above may occur for each pair of rollers and drive mechanism mounted to the form arrangement. Though only three sets are illustrated in FIG. 1, it may be preferred to provide up to eight or more sets of rollers to facilitate maximum pouring rates and stability for the forms.

The successive pairs may be selectively interconnected by flexible chains or cables (not shown) so that a desired spacing is adequately maintained between the succession of the roller pairs.

Pouring of concrete may begin simultaneously with operation of the drive mechanism to initiate motion of the roller pairs along the wall. The concrete is poured between the inwardly facing surfaces 18 of the sheet forms 11, preferably at or adjacent to the first pair of rollers moving along the predetermined path.

The roller pairs are driven to move along the sheet forms as the drive motors are activated. This may be responsive to conventional switching mechanisms or valving by switch hydraulic fluid under pressure is delivered to the individual drive motors 69. Operation of the drive motors will cause corresponding rotation of the drive gears. The drive gears, in turn, cause counter-rotation of the opposed rollers of each pair.

The rollers in each pair counter rotate, along with their upper and lower sprockets 40, 41. Sprockets 40, 41, being engaged with the associated guide tracks 28, 33 influence the forward directional motion of the rollers over the sheet forms.

The cylindrical surfaces of the rollers will move along and directly engage in rolling contact with the external or outwardly facing surfaces of the sheet forms. Thus, the rollers provide rigidity to the forms during the process of pouring the concrete wall. The successive roller pairs lend stability to the wall and prevent buckling or bulging of the forms while the concrete is being poured and during the time in which the concrete cures to a relatively self supporting state.

The rate of speed for the rollers is determined by the rate of pour and the set up time for the concrete. The number of roller pairs selected to be used is also a determining factor. A series of, say, eight pairs of rollers may be moved along the sheet forms at a relatively fast rate due to the number of rollers providing continuous support for the sheet forms as the concrete is being poured.

It is noted that the clutch mechanism is actuated to engage the friction surfaces along the straight wall form sections to impart simultaneously motion of the roller pairs along the straight segments of the predetermined path. This is assured by the single drive motors which drive both rollers of each pair.

It is important to note the simultaneous operation of the rollers by the single drive motor on each of the roller pairs. The single drive motor and the gear arrangement descibed above assure simultaneous movement of the rollers along the sheet forms. The rollers will remain in precise transverse orientations as they move along the elongated wall. The rotational velocities of the rollers are equal and opposite. Thus, regardless of the operating speed of the motor, the roller pair will progress along the sheet forms in precise transverse orientation to the wall length dimension. The resulting formation of the wall will therefore occur without the roller pairs binding against the sheet forms and consequently pressing the sheet forms inwardly to possibly produce variations in the wall thickness.

As a corner 13 is encountered along the sheet forms, the first switch 120 is engaged as the first pair of rollers arrive. The switch is positioned along the tracks to be actuated as the roller pair reach the corner track segments 36, 38. The switch will operate to actuate the clutch cylinder 82, which disengages the clutch friction surfaces 73, 75. Thus, driving force is removed from the adjacent roller 54 and it is allowed to remain relatively stationary on the inside corner track segment 36. The drive motor 69 continues to operate, driving the remaining roller to rotate with its sprockets moving about the outer segment of the corner.

The roller pair thus pivots, around the corner to a position where the two rollers are precisely transverse to the sheet forms that extend beyond the corner. At or near this point, the second switch 121 is encountered. This switch will operate the clutch to engage the friction surfaces 73, 75. Rotary motion is then again imparted to the rollers and attached sprockets so the roller pair will continue progress in unison along the predetermined path beyond the corner.

Of course, the above procedure will be repeated as each pair of rollers encounters the corner. The drive and clutch mechanisms descirbed above therefore facilitate continuous operation of the apparatus and will thereby permit continuous formation of the concrete wall along a predetermined path of substantially any selected length or configuration.

Following formation of the concrete wall, the apparatus may be dissembled simply by reversing the procedural steps discussed above for constructing the forms and assembling the roller pair in position. The dissembled unit may be stored in a relatively compact condition for later reuse.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications with the proper scope of the appended claims appropriately interpreted in accordance with the doctrine of equivalents.

I claim:

1. A concrete wall form apparatus for supporting sheet forms to prevent buckling or bulging of the forms while concrete is being poured between the sheet forms in a progressive formation of an elongated concrete wall along a predetermined path including a corner, the sheet forms having opposed outwardly facing surfaces and inwardly facing surfaces spaced apart to determine a finished wall thickness, comprising:

a pair of upright form engaging rollers, one for the outwardly facing surface of each form;

a carriage frame mounting the rollers for rotation against the outwardly facing surfaces in opposed relation across the wall thickness;

guide tracks mountable to the sheet forms and operatively engaging the form engaging rollers to guide the rollers along the predetermined path and along the outwardly facing surfaces of the sheet forms;

drive gears on the carriage frame in meshing engagement across the frame and interconnected with the rollers so that rotation of any one of the drive gears will cause corresponding counter rotation of the rollers against the outer surfaces of the sheet forms, thereby influencing movement of the apparatus along the predetermined path;

a drive motor on the carriage and connected to the drive gears for selectively rotating the drive gears; and a clutch interposed between at least one of said rollers and the drive gears, selectively operable as the apparatus encounters a corner along the predetermined path to disengage the one roller from the drive gears and thereby enable the one roller to freewheel while the remaining roller continues to rotate and move about the corner responsive to continued operation of the drive gears and drive motor.

2. The apparatus of claim 1 wherein the drive gears include a primary drive gear for each roller and a series of intermeshing pinion gears interconnecting the primary drive gears, and wherein the clutch is comprised of:

a clutch housing mounted to one of the drive gears for rotation therewith;

a first clutch member mounted to the clutch housing for rotation therewith;

a second clutch member operably mounted to the one roller for rotation therewith; and actuator means mounting one of the clutch members for selectively engaging and disengaging the other of the clutch members such that rotary motion of the one drive gear is selectively transmitted to the one roller.

3. The apparatus of claim 2 further comprising an idler insert mounted between and in engagement with the drive gears to selectively space the drive gears apart and thereby selectively adjust the distance between the rollers to accommodate diferring wall thickness dimensions.

4. The apparatus of claim 2 wherein the actuator means is comprised of an actuator cylinder mounted to the one clutch member so that actuation of the cylinder will cause the one clutch member to frictionally engage the other of the clutch members.

5. The apparatus of claim 4 further comprising an idler insert mounted between and in engagement with the drive gears to selectively space the drive gears apart and thereby selectively adjust the distance between the rollers to accommodate differing wall thickness dimensions.

6. The apparatus of claim 1 further comprising an idler insert mounted between and in engagement with the drive gears to selectively space the drive gears apart and thereby selectively adjust the distance between the rollers to accommodate differing wall thickness dimensions.

7. The apparatus of claim 6 wherein the idler insert includes:

a pair of idler gears;

a gear frame; and means mounting the pair of idler gears to the gear frame in meshing engagement with one another and with the drive gears.

8. The apparatus of claim 7 wherein the means mounting the pair of idler gears to the gear frame includes an adjustment means between at least one of the idler gears and the gear frame for permitting selective adjustment of the one idler gear about the other to effectively change the wall thickness dimension by selectively spacing the drive gears apart.

9. A concrete wall form roller drive for a concrete wall form apparatus for supporting sheet forms to prevent buckling or bulging of the forms while concrete is being poured between the sheet forms in a progressive formation of an elongated concrete wall along a predetermined path including a corner, the sheet forms having opposed outwardly facing surfaces and facing inward surfaces spaced apart to determine a finished wall thickness, said roller drive comprising:

a pair of parallel spaced apart rollers;

a carriage frame means for mounting the pair of rollers for rotation against the outwardly facing surfaces in opposed relation across the wall thickness;

drive gear means including drive gears on the carriage frame in meshing engagement with one another across the frame for interconnection with the rollers so that rotation of any one of the drive gears will cause corresponding counter rotation of the rollers against the outwardly facing surfaces of the sheet forms, thereby influencing movement of the roller drive along the predetermined path;

a drive motor on the carriage and connected to the drive gears for selectively rotating the drive gears; and a clutch means interposed between at least one of said rollers and the drive gears, for selective operation as the roller drive encounters a corner along the predetermined path to disengage the one roller from the drive gears and thereby enable the one roller to freewheel while the remaining roller continues to rotate and move about the corner responsive to continued operation of the drive gears and drive motor.

10. The roller drive of claim 9 wherein the drive gears include a primary drive gear for each roller and a series of intermeshing pinion gears interconnecting the primary drive gears, and wherein the clutch is comprised of:

a clutch housing mounted to one of the drive gears for rotation therewith;

a first clutch member mounted to the clutch housing for rotation therewith;

a second clutch member operably mounted to the one roller for rotation therewith; and actuator means mounting one of the clutch members for selectively engaging and disengaging the other of the clutch members such that rotary motion of the one drive gear is selectively transmitted to the one roller.

11. The apparatus of claim 10 further comprising an idler insert mounted between and in engagement with the drive gears to selectively space the drive gears apart and thereby selectively adjust the distance between the rollers to accommodate differing wall thickness dimensions.

12. The apparatus of claim 10 wherein the actuator means is comprised of an actuator cylinder mounted to the one clutch member such that actuation of the cylinder will cause the one clutch member to frictionally engage the other of the clutch members.

13. The apparatus of claim 12 further comprising an idler insert mounted between and in engagement with the drive gears to selectively space the drive gears apart and thereby selectively adjust the distance between the rollers to accommodate different wall thickness dimensions.

14. The apparatus of claim 9 further comprising an idler insert mounted between and in engagement with the drive gears to selectively space the drive gears apart and thereby selectively adjust the distance between the rollers to accommodate differing wall thickness dimensions.

15. The apparatus of claim 14 wherein the idler insert includes:

a pair of idler gears;
a gear frame; and
means mounting the pair of idler gears to the gear frame in meshing engagement with one onother and with the drive gears.

16. The apparatus of claim 7 wherein the means mounting the pair of idler gears to the gear frame includes an adjustment means between at least one of the idler gears and the gear frame for permiting selective adjustment of the one idler gear about the other.

17. A concrete wall forming apparatus, comprising:
a plurality of sheet forms, each having an outside and an inside surface;
a form support frame for supporting the sheet forms in spaced apart upright relation to determine a finished wall thickness, comprising:
a pair of upright form engaging rollers, one for the outside surface of each form;
a carriage frame mounting the rollers for rotation against the outside surfaces in opposed relation across the wall thickness;
guide tracks on the form support frame mountable to the sheet forms and operatively engaging the form engaging rollers to guide the rollers along the outside surfaces of the sheet forms;
drive gears on the carriage frame in meshing engagement across the form support frame and interconnected with the rollers so that rotation of any one of the drive gears will cause corresponding counter rotation of the rollers against the outside surfaces of the sheet forms, thereby influencing movement of the rollers along the predetermined path to prevent buckling or bulging of the forms while concrete is being poured between the sheet forms in a progressive formation of the concrete wall along a predetermined path including a corner;
a drive motor on the carriage and connected to the drive gears for selectively rotating the drive gears; and
a clutch interposed between at least one roller and the drive gears, selectively operable as the apparatus encounters a corner along the predetermined path to disengage the one roller from the drive gears and thereby enable the one roller to freewheel while the remaining roller continues to rotate and move about the corner responsive to continued operation of the drive gears and drive motor.

18. The apparatus of claim 17 wherein the carriage frame is removably mountable to the rollers and wherein the apparatus further comprises a secondary carriage frame including removable bearings rotatably journaling the rollers for securing the rollers apart a prescribed distance on the secondary frame and for releasing the rollers for removal from engagement with the outside form surfaces.

19. The apparatus of claim 17 further comprising footing spacer means for forming a footing at bottom ends of the sheet forms and for releasably mounting the sheet forms at selected heights to thereby enable formation of concrete walls of selected height dimensions.

20. The apparatus of claim 17 wherein the drive gears include a primary drive gear for each roller and a series of intermeshing pinion gears interconnecting the primary drive gears, and wherein the clutch is comprised of:
a clutch housing mounted to one of the drive gears for rotation therewith;
a first clutch member mounted to the clutch housing for rotation therewith;
a second clutch member operably mounted to the one roller for rotation therewith; and
actuator means mounting one of the clutch members for selectively engaging and disengaging the other of the clutch members such that rotary motion of the one drive gear is selectively transmitted to the one roller.

21. The apparatus of claim 20 further comprising an idler insert mounted between and in engagement with the drive gears to selectively space the drive gears apart and thereby selectively adjust the distance between the rollers to accommodate differing wall thickness dimensions.

22. The apparatus of claim 20 wherein the actuator means is comprising of an actuator cylinder mounted to the one clutch member so that actuation of the cylinder will cause the one clutch member to frictionally engage the outer of the clutch members.

23. The apparatus of claim 22 further comprising an idler insert mounted between and in engagement with the drive gears to selectively space the drive gears apart and thereby selectively adjust the distance between the rollers to accommodate differing wall thickness dimensions.

24. The apparatus of claim 17 further comprising an idler insert mouned between and in engagement with the drive gears to selectively space the drive gears apart and thereby selectively adjust the distance between the rollers to accommodate differing wall thickness dimensions.

25. The apparatus of claim 24 wherein the idler insert includes:
a pair of idler gears;
a gear frame; and
means mounting the pair of idler gears to the gear frame in meshing engagement with one another and with the drive gears.

26. The apparatus of claim 25 wherein the means mounting the pair of idler gears to the gear frame includes an adjustment means between at least one of the idler gears and the gear frame for permitting selective adjustment of the one idler gear about the other to effectively change the wall thickness dimension by selectively spacing the drive gears apart.

* * * * *